US006975927B2

(12) United States Patent
Szklar et al.

(10) Patent No.: US 6,975,927 B2
(45) Date of Patent: Dec. 13, 2005

(54) REMOTE CONTROL SYSTEM FOR LOCOMOTIVE WITH ADDRESS EXCHANGE CAPABILITY

(75) Inventors: Oleh Szklar, St. Hubert (CA); Folkert Horst, Pierrefonds (CA); Stephan P. Georgiev, St-Hubert (CA); Brigide Mattar, Ville Mont-Royal (CA)

(73) Assignee: Beltpack Corporation, Montreal (CA)

( * ) Notice: Subject to any disclaimer, the term of this patent is extended or adjusted under 35 U.S.C. 154(b) by 198 days.

(21) Appl. No.: 10/308,242

(22) Filed: Dec. 2, 2002

(65) Prior Publication Data

US 2003/0083791 A1 May 1, 2003

Related U.S. Application Data

(63) Continuation-in-part of application No. 09/281,464, filed on Mar. 30, 1999, and a continuation-in-part of application No. 10/163,199, filed on Jun. 4, 2002, which is a continuation of application No. 09/281,464, filed on Mar. 30, 1999, application No. 10/308,240, application No. 10/163,227, which is a continuation of application No. 09/281,464.

(51) Int. Cl.[7] ..... G06F 7/00

(52) U.S. Cl. ..... 701/19; 701/20; 246/187 A; 246/167 R

(58) Field of Search ..... 701/1, 2, 19, 20; 246/167 R, 182 R, 187 R, 187 A, 122 R, 187 C; 188/107

(56) References Cited

U.S. PATENT DOCUMENTS

| | | | |
|---|---|---|---|
| 3,639,755 | A | 2/1972 | Wrege |
| 4,245,347 | A | 1/1981 | Hutton et al. |
| 4,264,954 | A | 4/1981 | Briggs et al. |
| 4,529,980 | A | 7/1985 | Liotine et al. |
| 4,553,723 | A | 11/1985 | Nichols et al. |
| 4,582,280 | A | 4/1986 | Nichols et al. |
| 4,687,258 | A | 8/1987 | Astley |
| 4,912,463 | A | 3/1990 | Li |
| 5,039,038 | A | 8/1991 | Nichols et al. |
| 5,122,948 | A | 6/1992 | Zapolin |
| 5,495,520 | A | 2/1996 | Kojima |
| 5,511,749 | A | 4/1996 | Horst et al. |
| 5,533,695 | A | 7/1996 | Heggestad et al. |
| 5,570,284 | A | 10/1996 | Roselli et al. |

(Continued)

FOREIGN PATENT DOCUMENTS

| | | |
|---|---|---|
| DE | 36 18 464 A1 | 12/1987 |
| DE | 42 42 231 | 6/1994 |
| EP | 326 630 | 8/1989 |
| EP | 704 590 | 4/1996 |
| WO | WO 96/36953 | 11/1996 |

OTHER PUBLICATIONS

RCL Standard Draft White Paper Jul. 22, 2002, revision: 1.0.
Copy of a search report compiled by Information Works Inc. and dated May 20, 2003 entitled "Review of Technical and Trade Literature, 1980 and forward" and relating to remote control systems for locomotives.
Declaration of Folkert Horst dated Jun. 18, 2004.
Theimeg facsimile dated Mar. 21, 2004.
Theimeg facsimile dated Apr. 30, 1993.

*Primary Examiner*—Gertrude A. Jeanglaude
(74) *Attorney, Agent, or Firm*—Merchant & Gould PC

(57) ABSTRACT

A transmitter for remotely controlling a locomotive entity. The transmitter has a control entity capable of acquiring a plurality of states, including a linked state. The transmitter also has an interface in communication with the control entity for receiving an identifier of the locomotive entity via a communication link. The transmitter also has a proximity detector having a detection field, the proximity detector being in communication with the control entity to enable the control entity to switch to the linked state at least when the locomotive entity is in the detection field.

45 Claims, 1 Drawing Sheet

U.S. PATENT DOCUMENTS 5,681,015 A 10/1997 Kull
5,685,507 A 11/1997 Horst et al.
5,729,210 A * 3/1998 Kiriyama ..... 340/825.72
5,746,261 A 5/1998 Bowling
5,815,823 A 9/1998 Engle
5,884,146 A 3/1999 Simmons
6,218,961 B1 4/2001 Gross et al.
6,314,345 B1 11/2001 Coombes
6,400,281 B1 * 6/2002 Darby et al. ..... 340/933
6,449,536 B1 9/2002 Brousseau et al.
6,456,674 B1 9/2002 Horst et al.
6,466,847 B1 10/2002 Horst
6,470,245 B1 10/2002 Proulx

* cited by examiner

REMOTE CONTROL SYSTEM FOR LOCOMOTIVE WITH ADDRESS EXCHANGE CAPABILITY

This application is a continuation-in-part of:

Pending U.S. patent application Ser. No. 09/281,464 filed Mar. 30, 1999;

Pending U.S. application Ser. No. 10/163,199 filed Jun. 4, 2002 which is a continuation of U.S. patent application Ser. No. 09/281,464 filed Mar. 30, 1999; and Pending U.S. application Ser. No. 10/163,227 filed Jun. 4, 2002 which is a continuation of U.S. patent application Ser. No. 09/281,464 filed Mar. 30, 1999.

The contents of the above noted documents are hereby incorporated by reference.

FIELD OF THE INVENTION

This invention relates to the field of communication and control systems. It is particularly applicable to a method and apparatus for assigning machine addresses to computer or electronically controlled devices, and may be used to assign machine addresses to a control system using radio communication to transmit commands between a master controller and a slave controller.

SUMMARY OF THE INVENTION

Under a first broad aspect, the invention provides a transmitter for remotely controlling a locomotive entity. The transmitter has a control entity capable of acquiring a plurality of states that include a linked state in which the control entity generates commands for causing an action to be performed by the locomotive. The transmitter also has a first interface for receiving an identifier of the locomotive entity via a first communication link and a second interface for transmitting a signal over a second communication link different from the first communication link, the second communication link being an RF communication link. When the control entity is in the linked state, the signal transmitted over the second communication link includes commands to the locomotive entity for causing the locomotive entity to perform one or more actions. When the control entity is in a state other than the linked state, the signal transmitted over the second communication link including an identifier of the transmitter.

Under a second broad aspect, the invention provides a transmitter for remotely controlling a locomotive entity. The transmitter has a control entity capable of acquiring a plurality of states including a linked state. The control entity is capable of communicating with the locomotive entity via at least two communication links distinct from one another. The control entity is enabled to switch to the linked state at least when the control entity has received an identifier of the locomotive entity over one of the at least two communication links and has sent an identifier to the locomotive entity over another of the at least two communication links.

Under a third broad aspect, the invention provides a transmitter for remotely controlling a locomotive entity in which is mounted a slave controller. The transmitter has a control entity capable of acquiring a plurality of states including a linked state. The transmitter has a first interface for sending an identifier of the transmitter to the slave controller via a first communication link. The transmitter also has a second interface for transmitting a signal over a second communication link different from the first communication link, the second communication link being an RF communication link. When the control entity is in the linked state, the signal transmitted over the second communication link including commands to the slave controller for causing the locomotive entity to perform one or more actions. When the control entity is in a state other than the linked state, the communication link receiving via the second communication link and the second interface an identifier of the slave controller.

Under a fourth broad aspect, the invention further provides a transmitter for remotely controlling a locomotive entity. The transmitter has a control entity capable of acquiring a plurality of states, including a linked state. The transmitter also has an interface in communication with the control entity for receiving an identifier of the locomotive entity via a communication link. The transmitter also has a proximity detector having a detection field, the proximity detector being in communication with the control entity to enable the control entity to switch to the linked state at least when the locomotive entity is in the detection field.

BRIEF DESCRIPTION OF THE DRAWINGS

A detailed description of examples of implementation of the present invention is provided herein below with reference to the following drawings, in which.

Figure 1:
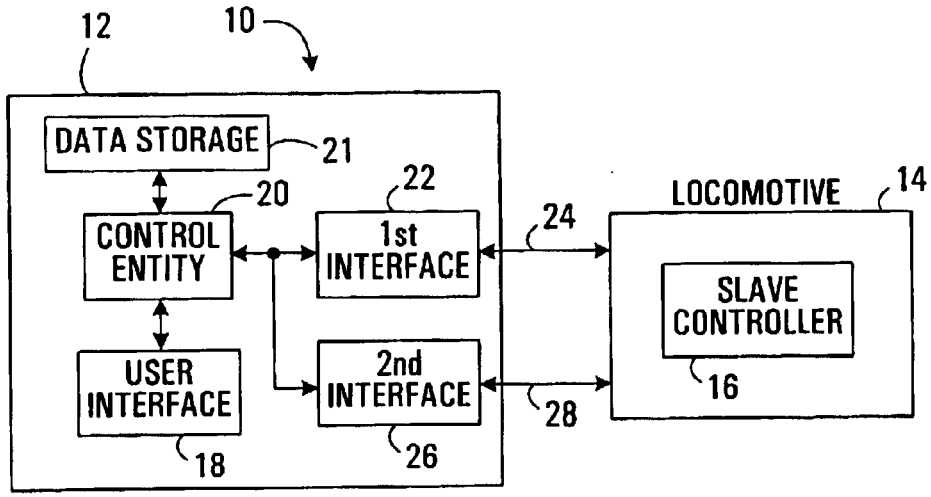
FIG. 1 is a block diagram of a remote control system for locomotive according to the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

FIG. 1 illustrates a remote control system for locomotive, designated comprehensively by 10. The system 10 includes a transmitter 12 normally carried by a human operator and used to send commands to a locomotive 14. The locomotive 14 includes a slave controller 16 that receives the commands sent from the transmitter 12 and interfaces with the locomotive controls such as to implements those commands. Examples of commands include an acceleration command to cause the locomotive 14 to move and a brake command to cause the locomotive 14 to brake. The combination of the locomotive 14 and the slave controller 16 will be designated in this specification by the expression "locomotive entity".

The transmitter 12 includes a user interface 18. The operator communicates with the transmitter via the user interface 18. Stated, otherwise, the operator enters commands to be implemented by the locomotive entity via the user interface 18 and if the transmitter is designed to send information back to the operator such information is sent via the user interface 18. Implementation examples of the user interface 18 include manually operated switches, keyboard, touch sensitive screen, pointing devices, voice recognition, an audio input, an audio output and video output among others.

The transmitter 12 includes a control entity 20. The control entity 20 provides the main controlling function of the transmitter 12. The control entity 20 can be implemented in hardware, in software or as a combination of hardware and software. The transmitter 12 further includes a first interface 22 via which the transmitter 12 communicates with the locomotive entity over a first communication channel 24.

The first communication channel 24 can be either wireless or wire based (here "wire" also includes an optical fiber). Examples in the wireless category include a Radio Frequency (RF) communication channel, an Infrared (IR) communication channel, and a communication channel based on Inductive Coupling (IC). The communication channel 22 uses any suitable protocol to allow data to be sent between the transmitter 12 and the locomotive entity.

The transmitter 12 further includes a second interface 26 via which the transmitter 12 communicates with the locomotive entity over a second communication channel 28. The second communication channel 28 is an RF communication channel.

Communication paths connect the user interface 18, the first interface 22 and the second interface 26 to the control entity 20 to allow internal signals to be exchanged between those components.

The control entity 20 can acquire a plurality of states. One of these states is the linked state. The linked state is a condition or mode during which the control entity 20 is "aware" or "recognizes" the locomotive entity that it controls. During that state, the control entity 20 will be sending commands to the locomotive entity that it recognizes. The linked state is the normal state of operation of the transmitter 12. In addition to the linked state, control entity 20 has a non-linked state. The non-linked state is a state during which control entity 20 cannot issue commands to a locomotive entity. It should be expressly noted that the control entity 20 could have more than two states, without departing from the spirit of the invention.

Conditions must be met to authorize the switching from a state other than the linked state to the linked state. Assume for the purpose of this example that the control entity 20 is in the non-linked state. One of the conditions to enable the switching is for the control entity 20 to "learn" which locomotive entity it will be controlling.

In the example of implementation shown at FIG. 1, the "learning" process is effected through the locomotive entity sending via the first communication link 24 a signal including an identifier of locomotive entity that is then stored in a data storage 21 of the control entity 20. During the linked state, the control entity 20 will use this identifier to build an address such as to send the commands to the proper locomotive entity. Optionally, the "learning" process also involves the control entity 20 sending via the second communication link 28 a signal including an identifier of the transmitter 12. That identifier also resides in the data storage 21 of the control entity 20. In a specific example of implementation, during the linked state the control entity 20 will use both the identifier of the locomotive entity and the identifier of the transmitter 12 to build a compound address or tag for such that the commands will be recognized only by the proper locomotive entity.

Alternatively, the identifier of the transmitter 12 can be sent out via the first communication link 24 and the identifier of the locomotive entity received via the second communication link 28.

The completion of such a "learning process" is a necessary condition to allow the control entity 20 to switch to the linked state. It should be expressly noted that such condition need not be the only condition and other conditions may be necessary or desired depending on the specific application. Accordingly, the invention encompasses embodiments where the completion of the "learning process" is but one condition in a set of several conditions that must be met in order for the switch to be authorized.

Once the switch to the linked state has been completed, the control entity 20 issues commands, based on the inputs made by the operator via the user interface 18, that are converted into necessary signals sent over the second communication link 28. In this state, if the first communication link 24 is wire based, such wire would be disconnected to allow the necessary freedom of movement of the operator beside the locomotive entity.

Figure 2:
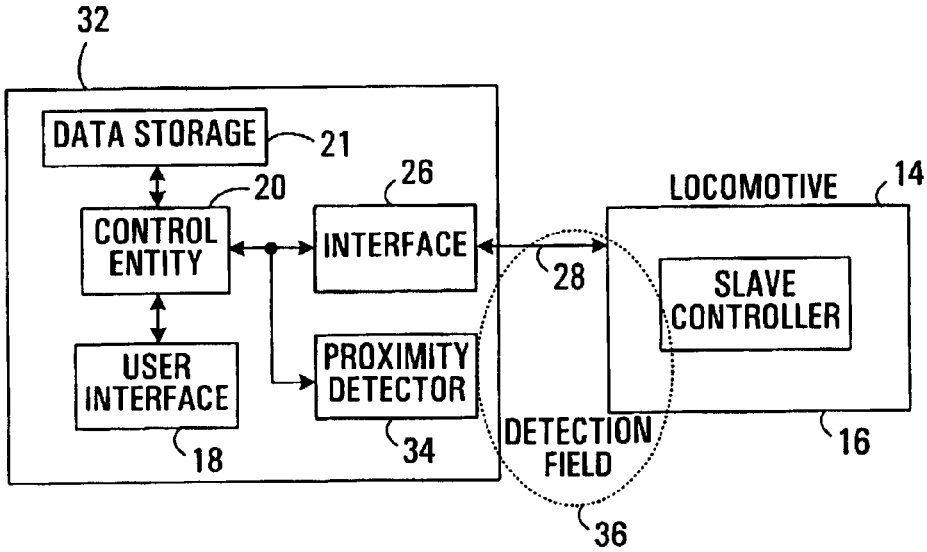
FIG. 2 is a block diagram of a remote control system for locomotive according to a variant.

FIG. 2 illustrates a variant of the invention. In this variant, components identical or similar to those described in FIG. 1 are identified using the same reference numerals.

In FIG. 2 the transmitter 32 is provided with a proximity detector 34 that enables the control entity 20 to switch to the linked state only when the proper locomotive entity is within the detection field 36 of the proximity detector 34.

In the embodiment shown at FIG. 2, any suitable arrangement can be used to communicate the identifier of the locomotive entity to the transmitter 32. Specific examples include:

1. Sending the identifier via the RF communication channel 28;
2. Sending the identifier via another communication channel, different from the RF communication channel 28, such as the communication channel 24 illustrated in FIG. 1;
3. The operator manually inputting the identifier via the user interface 18; and
4. Obtaining the identifier via any type of electronic communication with an entity distinct from the locomotive entity;

Optionally, the transmitter 32 is provided with some means for communicating the identifier of the transmitter 32 to the locomotive entity. Those means may include any one or a combination of the examples above.

The proximity detector 34 has a detection field 36 and it is designed to sense the locomotive entity when that locomotive entity is within the detection field 36. The presence of the locomotive entity in the detection field 36 is a condition necessary to allow the control entity 20 to switch to the linked state.

In a first optional embodiment, the locomotive entity includes a module adapted to be detected by the proximity detector. In such an embodiment, when the module is within the detection field 36, the exchange of identifiers between the locomotive entity and the transmitter 32 is allowed. For example, the presence of the module within the detection field 36 is a condition for allowing the locomotive entity to transmit the locomotive identifier and for the transmitter 32 to accept the locomotive identifier over transmission link 28. In a non-limiting example, the presence of the module within the detection field 36 is a condition for allowing the transmitter 32 to transmit the transmitter identifier and for the locomotive entity to accept the transmitter identifier over transmission link 28.

In another optional embodiment, the proximity detector 34 not only senses that a locomotive entity is present in the detection field 36 but it can also discriminate between different locomotive entities such as to allow the control entity 20 to internally verify that the locomotive entity with which it will link is the same that is within the detection field 36. This feature provides a safety benefit and reduces the possibility of linking with the wrong locomotive entity.

Examples of proximity detectors 34 with discrimination capability include, but are not limited to:

1) Wireless Based:

a) An IR detector that senses an IR emission output by the locomotive entity. The IR emission includes a unique code that allows the proximity detector 34 to distinguish that locomotive entity from another locomotive entity;

b) A detector based on inductive coupling that functions as discussed in (a);

c) An RF interrogator that interrogates a transponder on the locomotive entity;

d) An optical reader that can remotely read a code on the locomotive entity, such as a bar code reader.

2) Wire Based:

a) Any physical conductor including an optical fiber that can be connected between the transmitter 32 and the locomotive entity such as to establish an effective detection field 36. Typically, the length of the conductor defines the size of the detection field 36. Such physical conductor allows the proximity detector 34 to sense the presence of a locomotive entity and optionally to receive from the locomotive entity the unique code. The reader will appreciate that during the operation of the transmitter 32 in the linked state, a wire based proximity detector 34 will need to be disconnected from the locomotive entity. Thus, such wire based proximity detector 34 is connected to the locomotive entity only to allow the control entity 20 to switch to the linked state.

When the proximity detector 34 senses the presence of a locomotive entity in the detection field 36, it passes the unique code gathered during the sensing to the control entity 20 that determines if it matches the identifier of the locomotive entity entered. If they match a switch to the linked state can take place. Here "match" is used in a broad sense to indicate that the control entity 20 determines that the identifier and the unique code are associated with the same locomotive entity. As such the identifier and the unique code do not need to be identical.

Another optional condition that could be set to allow the control entity 20 to switch to the linked state includes sending the identifier of the transmitter to the locomotive entity. This can be accomplished via the communication link 28 or via the communication link 24, if the transmitter 32 is provided with such communication link 24.

Although the proximity detector 34 is shown in FIG. 2 as being part of the transmitter 32, the proximity detector may alternatively be part of the locomotive entity. The operation of the proximity detector is substantially similar to that described above. For example, the proximity detector 34 has a detection field 36 and designed to sense the transmitter when the transmitter is within the detection field 36. The presence of the transmitter in the detection field 36 is a condition necessary to allow the control entity 20 to switch to the linked state. In yet another alternative, the components of the proximity detector may be distributed between the transmitter and the locomotive entity.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A transmitter for remotely controlling a locomotive entity, said transmitter comprising:

a) a control entity capable of acquiring a plurality of states, said plurality of states including a linked state in which said control entity generates commands for causing an action to be performed by the locomotive entity;

b) a first interface in communication with said control entity, said first interface being operative for receiving an identifier of the locomotive entity via a first communication link;

c) a second interface in communication with said control entity, said second interface being operative for transmitting a signal over a second communication link different from the first communication link, the second communication link being an RF communication link;

d) wherein when said control entity is in said linked state, the signal transmitted over said second communication link includes commands for causing the locomotive entity to perform one or more actions; and e) wherein when said control entity is in a state other than said linked state, the signal transmitted over said second communication link includes an identifier of said transmitter.

2. A transmitter as defined in claim 1, wherein the one or more actions to be performed by the locomotive entity includes accelerating.

3. A transmitter as defined in claim 2, wherein the one or more actions to be performed by the locomotive entity includes braking.

4. A transmitter as defined in claim 3, wherein said control entity includes a data storage for storing the identifier of the locomotive entity received via the first communication link.

5. A transmitter as defined in claim 4, wherein said data storage stores the identifier of said transmitter.

6. A transmitter as defined in claim 2, wherein the first communication link is a wireless link.

7. A transmitter as defined in claim 6, wherein the first communication link is selected from the group consisting of IR link, RF link and IC link.

8. A transmitter as defined in claim 2, wherein the first communication link is a wire based link.

9. A transmitter as defined in claim 2, wherein the state other than said linked state is a non-linked state in which said control entity is disabled from issuing acceleration commands to the locomotive entity.

10. A transmitter as defined in claim 2, wherein said control entity is enabled to switch to said linked state at least when the identifier of the locomotive entity has been received via the first communication link and when the identifier of said transmitter has been sent to the locomotive entity via the second communication link.

11. A transmitter for remotely controlling a locomotive entity, said transmitter comprising:

a) a control entity capable of acquiring a plurality of states, said plurality of states including a linked state in which said control entity issues commands for causing an action to be performed by the locomotive entity;

b) said control entity being capable of communicating with the locomotive entity via at least two communication links distinct from one another;

c) said control entity being enabled to switch from a state other than said linked state to said linked state at least when said control entity has received an identifier of the locomotive entity over a first communication link of the at least two communication links and has sent an identifier to the locomotive entity over a second communication link of the at least two communication links;

d) wherein when said control entity is in said linked state, said control entity transmits over said second communication link a signal including commands for causing the locomotive entity to perform one or more actions.

12. A transmitter as defined in claim 11, wherein the one or more actions to be performed by the locomotive entity includes accelerating.

13. A transmitter as defined in claim 12, wherein the one or more actions to be performed by the locomotive entity includes braking.

14. A transmitter as defined in claim 12, wherein said control entity includes a data storage for storing the identifier of the locomotive entity received over the first communication link of the at least two communication links.

15. A transmitter as defined in claim 14, wherein said data storage stores the identifier of said transmitter.

16. A transmitter as defined in claim 12, wherein one of the at least two communication links is a wireless link.

17. A transmitter as defined in claim 12, wherein the one of the at least two communication links is selected from the group consisting of IR link, RF link and IC link.

18. A transmitter as defined in claim 12, wherein one of the at least two communication links is a wire based link.

19. A transmitter as defined in claim 12, wherein the state other than said linked state is a non-linked state in which said control entity is disabled from issuing commands to the locomotive entity that cause the locomotive entity to accelerate.

20. A transmitter for remotely controlling a locomotive entity, said transmitter comprising:

a) a control entity capable of acquiring a plurality of states, said plurality of states including a linked state in which said control entity generates commands for causing an action to be performed by the locomotive entity;

b) a first interface in communication with said control entity, said first interface being operative for sending an identifier of said transmitter to the locomotive entity via a first communication link;

c) a second interface in communication with said control entity, said second interface being operative for issuing a signal over a second communication link different from the first communication link, the second communication link being an RF communication link;

wherein when said control entity is in said linked state, the signal transmitted over said second communication link includes commands for causing the locomotive entity to perform one or more actions; and wherein when said control entity is in a state other than said linked state, said second interface is operative for receiving via the second communication link an identifier of the locomotive entity.

21. A transmitter as defined in claim 20, wherein the one or more actions to perform by the locomotive entity is accelerating.

22. A transmitter as defined in claim 21, wherein the one or more actions to perform by the locomotive entity is braking.

23. A transmitter as defined in claim 22, wherein said control entity includes a data storage for storing the identifier of the locomotive entity received via the second communication link.

24. A transmitter as defined in claim 23, wherein said data storage stores the identifier of said transmitter.

25. A transmitter as defined in claim 21, wherein the first communication link is a wireless link.

26. A transmitter as defined in claim 21, wherein the first communication link is selected from the group consisting of IR link, RF link and IC link.

27. A transmitter as defined in claim 21, wherein the first communication link is a wire based link.

28. A transmitter as defined in claim 21, wherein the state other than said linked state is a non-linked state in which said control entity is disabled from generating commands for causing an action to be performed by the locomotive entity.

29. A transmitter as defined in claim 21, wherein said control entity is enabled to acquire said linked state at least when the identifier of the locomotive entity has been received via the second communication link and the identifier of said transmitter has been sent to the locomotive entity via the first communication link.

30. A transmitter for remotely controlling a locomotive entity, said transmitter comprising:

a) a control entity capable of acquiring a plurality of states, said plurality of states including a linked state in which said control entity is enabled to generate commands to a predetermined locomotive entity for causing an action to be performed by the predetermined locomotive entity;

b) means for communicating an identifier of the locomotive entity to said transmitter;

c) a proximity detector having a detection field, said proximity detector being in communication with said control entity to enable said control entity to switch from a state other than said linked state to said linked state at least when the predetermined locomotive entity is in said detection field; and d) said proximity detector being distinct from said means for communicating.

31. A transmitter as defined in claim 30, wherein said proximity detector has a discrimination ability to distinguish between different locomotive entities.

32. A transmitter as defined in claim 31, wherein said proximity detector is adapted to disable said control entity to switch from a state other than said linked state to said linked state when the locomotive entity other than the predetermined locomotive entity is in said detection field.

33. A transmitter as defined in claim 32, wherein said means for communicating includes an RF communication link, said RF communication link conveying signals to the predetermined locomotive entity containing the commands generated by said control entity for causing an action to be performed by the predetermined locomotive entity.

34. A transmitter as defined in claim 32, wherein said means for communicating includes a communication link distinct from said RF communication link.

35. A transmitter as defined in claim 34, wherein said communication link distinct from said RF communication link is an IR communication link.

36. A transmitter as defined in claim 32, wherein said means for communicating is operative to establish an electronic communication with an entity different from the locomotive entity to obtain from the entity different from the locomotive entity the identifier of the locomotive entity.

37. A transmitter as defined in claim 32, wherein said control entity is enabled to switch from a state other than said linked state to said linked state at least when said control entity has sent an identifier of said transmitter unit to the predetermined locomotive entity via the communication link.

38. A transmitter as defined in claim 32, wherein the state other than said linked state is a non-linked state in which said control entity is disabled from issuing commands to the predetermined locomotive entity for causing the locomotive entity to accelerate.

39. A transmitter as defined in claim 32, wherein said control entity includes a data storage for storing the identifier of the predetermined locomotive.

40. A transmitter as defined in claim 32, wherein said control entity includes a data storage for storing the identifier of said transmitter.

41. A transmitter as defined in claim 32, wherein said proximity detector is capable to derive an identification code associated with a locomotive entity when the locomotive entity is in the detection field of said proximity detector.

42. A transmitter as defined in claim 41, wherein said control entity is operative to compare the identification code and the identifier of the locomotive entity entered via said means for communicating and enters the linked state at least when the identification code matches the identifier of the locomotive entity entered via said means for communicating.

43. A transmitter as defied in claim 32, wherein said proximity detector is wireless.

44. A transmitter as defined in claim 43, wherein said proximity detector is selected from the group consisting of IR detector, a detector based on inductive coupling, an RF interrogator and an optical based reader that can remotely read the unique code on the locomotive entity.

45. A transmitter as defined in claim 32, wherein said proximity detector is a wire based detector.

* * * * *